US010280916B2

(12) United States Patent
Sauer et al.

(10) Patent No.: US 10,280,916 B2
(45) Date of Patent: May 7, 2019

(54) DIAPHRAGM PUMP FOR DOSING A FLUID AND AN ACCORDING METHOD

(75) Inventors: Wolfgang Sauer, Bischofswiesen (DE); Rudolf Albrecht, Bad Aibling (DE)

(73) Assignee: Ecolab USA Inc., Saint Paul, MN (US)

( * ) Notice: Subject to any disclaimer, the term of this patent is extended or adjusted under 35 U.S.C. 154(b) by 434 days.

(21) Appl. No.: 14/235,693

(22) PCT Filed: Jul. 28, 2011

(86) PCT No.: PCT/EP2011/063036
§ 371 (c)(1),
(2), (4) Date: Jan. 28, 2014

(87) PCT Pub. No.: WO2013/013725
PCT Pub. Date: Jan. 31, 2013

(65) Prior Publication Data

US 2014/0169985 A1 Jun. 19, 2014

(51) Int. Cl.

| | |
|---|---|
| ***F04B 49/12*** | (2006.01) |
| ***F04B 43/08*** | (2006.01) |
| ***F04B 9/04*** | (2006.01) |
| ***F04B 43/04*** | (2006.01) |

(Continued)

(52) U.S. Cl.
CPC ..... *F04B 49/125* (2013.01); *F04B 9/045* (2013.01); *F04B 13/00* (2013.01); *F04B 17/03* (2013.01);

(Continued)

(58) Field of Classification Search
CPC ..... F04B 9/045; F04B 13/00; F04B 17/03; F04B 17/04; F04B 17/042;

(Continued)

(56) References Cited

U.S. PATENT DOCUMENTS 4,925,371 A 5/1990 Griesmar
5,120,199 A * 6/1992 Youngs ..... F04B 49/065 417/12

(Continued)

FOREIGN PATENT DOCUMENTS

CN 101245770 A 8/2008
CN 201582069 U 9/2010

(Continued)

OTHER PUBLICATIONS

International Patent Application No. PCT/EP2011/063036, International Search Report and Written Opinion dated Jun. 1, 2012, 9 pages.

*Primary Examiner* — Devon C Kramer
*Assistant Examiner* — Christopher J Brunjes
(74) *Attorney, Agent, or Firm* — Fredrikson & Byron, P.A.

(57) ABSTRACT

A diaphragm pump (10), in particular for use as a detergent dosage pump, comprises a pump housing (12) with at least a first check valve (14) and a second check valve (16), a fluid chamber (18), a diaphragm (20) defining a wall of the fluid chamber (18) and reciprocatingly movable, driving means (28) with a driving shaft (30) for reciprocating said diaphragm (20), a control unit (36), wherein the driving means (28) is connected to the diaphragm (20) by an eccentric (26) and a con rod (24), wherein the driving means (28) is configured as a gearless drive to directly reciprocate the diaphragm (20). The diaphragm pump (10) according to the invention offers increased cost efficiency and further it is possible to increase the dosing capabilities of the diaphragm pump (10).

17 Claims, 2 Drawing Sheets

(51) Int. Cl.
*F04B 13/00* (2006.01)
*F04B 17/03* (2006.01)

(52) U.S. Cl.
CPC ..... *F04B 43/04* (2013.01); *F04B 43/082* (2013.01); *F04B 2201/0201* (2013.01); *F04B 2201/1208* (2013.01); *F04B 2203/0213* (2013.01)

(58) Field of Classification Search
CPC ..... F04B 2201/0201; F04B 2201/1208; F04B 2203/0213; F04B 43/04; F04B 43/082; F04B 43/02; F04B 43/043; F04B 49/125; F04B 45/04; F04B 45/047; F04B 35/045; F04B 49/02; F04B 49/20; F04B 2203/0209
USPC ..... 222/16, 63, 33
See application file for complete search history.

(56) References Cited

U.S. PATENT DOCUMENTS 5,676,527 A 10/1997 Ogikubo
5,932,987 A 8/1999 McLoughlin
5,971,723 A 10/1999 Bolt
5,996,422 A * 12/1999 Buck ..... F04B 49/065 702/25
6,109,881 A * 8/2000 Snodgrass ..... F04B 43/067 417/387
2004/0234377 A1* 11/2004 Bolt ..... F04B 7/0076 417/44.1
2006/0071622 A1* 4/2006 Townsend ..... B25J 9/1612 318/400.31
2006/0228234 A1* 10/2006 Rinehart ..... F04B 43/073 417/395
2007/0253832 A1* 11/2007 Kenney ..... B01L 3/021 417/53
2009/0302787 A1* 12/2009 Edelson ..... H02K 17/12 318/254.1
2010/0212635 A1* 8/2010 Allen ..... F02M 35/10032 123/445

FOREIGN PATENT DOCUMENTS

DE 19623537 12/1997
DE 202005013089 U1 1/2007
EP 0077908 5/1983

* cited by examiner

DIAPHRAGM PUMP FOR DOSING A FLUID AND AN ACCORDING METHOD

TECHNICAL FIELD OF THE INVENTION

The present invention relates to a diaphragm pump, in particular for use as a detergent dosage pump, and an according method.

BACKGROUND OF THE INVENTION

Diaphragm and piston pumps are used to supply metered quantities of liquids with various properties. Depending on the field of application, the pump behaviour is subject to various requirements in order to ensure that the delivered quantity of the metered medium is as precise as possible and remains constant for as long as possible.

Diaphragm pumps are common industrial pumps that use positive displacement to move liquids. These devices typically include a single diaphragm and chamber, as well as discharge check valves to prevent back-flow. Pistons are either coupled to the diaphragm or used to force hydraulic oil to drive the diaphragm. Diaphragm pumps are normally highly reliable because they do not include internal parts that rub against each other. Diaphragm pumps can handle a range of media that includes abrasive materials, acids, chemicals, or the like since the drive means is normally completely separated from hydraulic part of the pump. Since diaphragm pumps can deliver small volumes of fluid with the maximum discharge, they are especially suitable as dosage pumps.

Another reason for using diaphragm pumps as dosage pumps is that these pumps have two strokes, i.e. an aspiration stroke in which the medium is aspirated from a reservoir and a compression stroke or delivery stroke where delivery of the metered medium e. g. into a metered line takes place. Diaphragm pumps known in the art for instance comprise suction check valves as well as discharge check valve to prevent back-flow. These check valves are usually spring biased and are opened and closed by the pressure difference of the medium to be pumped. The check valves are normally only operated by the differential pressure of the fluid. This compression spring exerts a comparatively low spring force in order to ensure that the check valve can easily be opened. This applies in particular to the check valve on the suction side of the pump.

There is a permanent need to increase the cost efficiency of diaphragm pumps, and to improve the dosing capabilities of diaphragm pumps.

It is therefore an object of the present invention to provide an improved diaphragm pump which offers an increased cost efficiency, further it is desirable to increase the dosing capabilities of the diaphragm pump.

SUMMARY OF THE INVENTION

This object is solved by means of a diaphragm pump for dosing fluids, in particular for use as a detergent dosage pump, having the features of claim 1 and by means of a method for dosing a fluid having the features of claim 9. Preferred embodiments, additional details, features, characteristics and advantages of the object of the invention of said diaphragm pump and said method are disclosed in the subclaims.

In a general aspect of the invention the diaphragm pump, in particular for use as a detergent dosage pump, comprises a pump housing with at least a first check valve and a second check valve, a fluid chamber, a diaphragm defining a wall of the fluid chamber and reciprocatingly movable, driving means with a driving shaft for reciprocating said diaphragm, a control unit, wherein the driving means is connected to the diaphragm by an eccentric and a con rod, wherein the driving means is configured as a gearless drive to directly reciprocate the diaphragm.

The pumping housing may accommodate a fluid chamber, a diaphragm and at least a first check valve and a second check valve, wherein he first check valve may allow a fluid to flow into the fluid chamber, for example during a suction cycle of the diaphragm pump, and the second check valve may allow the fluid to leave the fluid chamber, for example during a dosage cycle of the diaphragm pump, preventing the fluid flowing back into the fluid chamber after being expelled from the fluid chamber. The diaphragm pump may be optimized for self priming A control unit is provided for controlling the operation of the diaphragm pump, in particular for controlling a driving means, for example the driving speed of the driving means. The driving speed of the driving means is a rotational speed which may be measured in revolutions per minute, rpm. The driving means comprises a driving shaft, wherein the driving shaft is rotating at the rotational speed of the driving means. The driving means is connected to an eccentric, wherein the eccentric is connected to a basically rigid con rod. The con rod is connected, for example elastically, to the diaphragm so that the rotational movement of the driving means and/or the eccentric may be transferred into a basically translational reciprocating movement of the con rod for reciprocating the diaphragm. The diaphragm may be basically rigid apart from a flexible diaphragm-edge in order to obtain a pressure independent displacement of the fluid. The driving means for reciprocating the diaphragm is configured without a gearbox, gearboxless, in form of a gearless drive, for reciprocating the diaphragm directly with the speed of the driving means, the driving speed. The driving means is configured transmissionless as a direct drive in order to drive the diaphragm directly.

The diaphragm pump according to the present invention has a few advantages over devices according to the state of the art. For example, omitting the gearbox enables the manufacturing costs of the diaphragm pump to be significantly lowered, hence increasing the cost efficiency of the diaphragm pump. Furthermore, the gearless drive reduces transmission losses thus increasing the efficiency of the diaphragm pump. A further advantage is that without a gearbox the noise of the diaphragm pump emitted during operation may be reduced. Further, without the gearbox the endurance of the diaphragm pump can be increased, increasing the reliability of the diaphragm pump. Another advantage of the improved diaphragm pump is that by directly driving the diaphragm by the driving means without gearbox, the driving means is enabled to drive the diaphragm more dynamically hence improving the dosing capabilities of the diaphragm pump.

In another embodiment of the invention the driving means is a stepper motor, in particular a hybrid stepper motor. The stepper motor may be designed in form of a brushless, electric motor that can divide a full rotation into a large number of steps. The stepper motor comprises a driving shaft and the positioning of the driving shaft may be controlled precisely. A hybrid stepper motor combines the principles of a permanent magnet motor and a variable reluctance motor, providing a basically constant high torque and enabling a modulation of the driving speed with high dynamics. The modulation with high dynamics means a modulation, wherein the desired change in the driving speed is executed swiftly without delay. The stepper motor or the hybrid stepper motor may be controlled by the control unit, enabling a precise positioning of the diaphragm with high dynamics.

In another preferred embodiment of the invention the eccentric is directly attached to the driving shaft of the driving means. The eccentric may be attached to the driving by positive fitting and/or firmly bonded to the driving shaft. By attaching the eccentric directly to the driving shaft of the stepper motor, it is possible to omit the gearbox and drive the diaphragm directly with the driving means. Further the stepping motor allows a precise control of the movement of the diaphragm, for example by a modulated driving speed, which further increases the dosing capabilities of the diaphragm pump.

In a particularly preferred embodiment of the invention a detector unit is provided for detecting an angular position of the driving means and/or the eccentric. The detector unit may detect an angular position of the driving shaft of the driving means, for example the hybrid stepping motor. The detector unit may detect an absolute angular position of the driving means, for example using a giant magneto resistance angular sensor, for example when the driving means is not operating, and/or the detector unit may detect a change in an angular position of the driving means, in particular the driving shaft, for example when the driving means is operating. The detector unit may be connected to the control unit in order to send a position signal and/or a position change signal to the control unit. This has the advantage that the control unit may alter or modulate the driving speed of the driving means, in particular of the hybrid stepper motor, depending on the position of for example the driving shaft and/or the eccentric which is attached to the driving shaft.

Furthermore, in a preferred embodiment of the invention the detector unit comprises an indicating means connectable to the driving means and/or the eccentric and sensor for detecting the indicating means. The indicating means may be connected to the driving shaft, wherein the sensor, for example an optical sensor, may be located separately. The indicating means may correspond to a full dosing cycle and/or a full suction cycle, thus allow for detecting the position of the diaphragm according to the dosing and/or suction cycle.

In a further preferred embodiment of the invention the indicating means is a reflective surface arranged on at least a part of the peripheral area and/or a face side of the driving means and/or the eccentric. The indicating means may be attached, for example at the face side, to the driving shaft and/or the eccentric. The indicating means may be a reflective surface or surface coating, for example a light reflecting paint, suitable to reflect light which may be emitted by the sensor of the detector unit. The indicating means may be located on at least a part of the peripheral surface of the driving shaft and/or the eccentric. The indicating means may extend about 180° along the peripheral surface of the driving shaft and/or eccentric, wherein the indicating means is allocated to a defined position of the diaphragm, for example the suction cycle and/or the dosing cycle, in particular a full dosing cycle and/or a full suction cycle. For example an indicating means may extend about 180° on the peripheral surface of the eccentric and be allocated to the dosing cycle, wherein the other about 180° are not provided with an indicating means, enabling the detection whether a dosing or suction cycle is active. There may be separate and by the sensor separable indicating means for both the dosing cycle and the suction cycle. The indicating means may also be attached on a face side of the driving means and/or the eccentric and/or the driving shaft, for example in the shape of a semi circle, corresponding to the dosing cycle or the suction cycle.

In a further preferred embodiment of the invention the sensor is integrated into the control unit. The sensor, in particular an optical sensor, may be integrated in to the control unit of the diaphragm pump, for example by arranging the sensor on a circuit board of the control unit. This enables a cost efficient production of the detector unit, in particular of the sensor.

In a preferred embodiment of the invention the con rod is directly attached to the diaphragm, preferably by a bolted connection. The diaphragm may comprise a connector for connecting the diaphragm to the con rod, wherein the connector may be arranged on a side of the diaphragm facing away from the fluid chamber and wherein the connector may consist at least partially of an elastic material. The connector may be attached to the diaphragm in order to increase the rigidity of the diaphragm by spreading a force, for example transmitted from the con rod, over a large area of the diaphragm, so that the stress inside the diaphragm is reduced. The con rod may be bolted onto the diaphragm and/or the connector enabling a coupling, in particular a flexible coupling, of the diaphragm with the con rod. This design enables the reliable transmission of power from the driving means, in particular the con rod, to the diaphragm, when the diaphragm pump is in use.

A further aspect of the present invention is a method for dosing a fluid, comprising the steps of providing a diaphragm pump according to any of the claims 1 to 8, starting a dosing cycle by dosing at least part of the fluid inside of the fluid chamber, starting a suction cycle, preferably after at least partly dosing the fluid.

The diaphragm pump may start with either a dosing cycle or a suction cycle on power up. In a dosing cycle for example the fluid inside the fluid chamber is expelled through the for example second check valve from the fluid chamber by a dosing movement of the diaphragm. During the dosing cycle at least a part of the fluid inside the fluid chamber is expelled and/or dosed. An at least partially empty fluid chamber may, for example after a dosing cycle, be filled by starting a suction cycle in order to suck fluid into the fluid chamber through for example the first check valve, wherein the diaphragm moves outwards thus increasing the volume of the fluid chamber. The dosing cycle and suction cycle may be repeated over and again depending on the amount of fluid to be dosed. The method of dosing a fluid with a diaphragm pump according to the invention has the advantage that due to the simplified construction of the pump the cost efficiency is increased. Further, the heat dissipation may be reduced and by driving the diaphragm directly, the control of the diaphragm movement is improved, thus improving the dosing capabilities.

In a preferred embodiment of the method an angular position of the driving means and/or the eccentric is detected, the diaphragm is moved to a defined position, for example the beginning of the dosing cycle, optionally after completing a suction cycle for filling the fluid chamber. An angular position of the driving means, in particular the driving shaft for example of a hybrid stepper motor, and/or an eccentric may be detected by a detector unit, comprising an indicating means and a sensor, in particular an optical sensor. An indicating means designed to correspond to the dosing cycle and/or the suction cycle, for example in form of a face side mounted half-circle shaped reflective surface on for example the eccentric, for example corresponding to the dosing cycle or the suction cycle, may be detected by the sensor. Depending on the position of the indicating means at the power up of the diaphragm pump, the sensor either detects the indicating means, for example the reflective surface, or not. The diaphragm may be moved by the driving means either way, through a dosing or a suction cycle, until the sensor detects the end or the beginning of the indicating means, wherein the control unit may stop the driving means and the movement of the diaphragm. As the indicating means corresponds either to the dosing cycle or the suction cycle, it is thus possible to move the diaphragm into a defined position, for example the beginning of the dosing cycle. For example, if the indicating means corresponds to the dosing cycle and the sensor detects the indicating means on power up, the control unit has the indication that the diaphragm is positioned in a dosing cycle and may control the driving means in order to move the diaphragm in the direction of the suction cycle, filling the fluid chamber, until the sensor senses the end of the indicating means. This "yes or no" indicating means provides a cost efficient way to indicate a dosing and/or suction cycle and to enable moving the diaphragm into a defined position, optionally after completing a suction cycle first for filling the fluid chamber. An constant detection of an absolute angular position of the driving means and thus the position of the diaphragm and the cycle may be detected for example by a giant magneto resistance (GMR) angular sensor, for example when the driving means is reciprocating the diaphragm and/or when the driving means is not operating in order to verify the position of the diaphragm, in order to allow for directly moving the diaphragm into a defined position along the shortest way. This has the advantage that the dosing capabilities of the diaphragm pump may be increased.

In a particularly preferred embodiment the method comprises the step of modulating the driving speed in order to provide a basically constant volumetric flow of the fluid. The control unit may modulate the driving speed of the driving means as a function of the angular position of the driving means and/or the eccentric, the position of the diaphragm, and/or of the cycle of the diaphragm pump, in particular during the dosing cycle and/or the suction cycle. Due to the construction of diaphragm pumps the diaphragm has to change its working direction at the end of each cycle and accordingly the volume of fluid moved by the diaphragm during a cycle may not be constant. The driving speed may be modulated or varied by an inverse sinus (1/sin) modulation, thus providing a basically constant volumetric flow of the fluid during the dosing cycle. By modulating the driving speed of the driving means with high dynamics, a fast responding change in the driving speed, it is possible to provide a basically constant volumetric flow of fluid during a cycle, for example during the dosing cycle and/or the suction cycle. The driving speed may be lower in the middle of a cycle than at the beginning and/or the end of a cycle. Further, with the modulation of the driving speed a hydraulic shock at the end and/or the beginning of a cycle may be reduced.

In a further preferred embodiment the method comprises the step of controlling the length of the dosing cycle in order to dose at least a part of the fluid with a basically constant volumetric flow for a given time. This allows for a time proportional dosing cycle, wherein the dosing of at least a part of the fluid is conducted with a basically constant volumetric flow for a given time. During the proportional dosing cycle the volumetric flow of the fluid is basically constant and the duration of the dosing is controlled. After a power-up of the diaphragm pump the control unit may move the diaphragm via the driving means into a defined position, for example the beginning of a dosing cycle, if needed after a suction cycle. The proportional dosing cycle allows for dosing an exact amount of fluid, for example detergent, wherein the amount of fluid to be dosed is adjustable.

In a preferred embodiment of the method the driving speed for the suction cycle is modulated in a way to avoid outgassing in the fluid. Moving the diaphragm to fast and thus for example reducing the pressure inside the fluid chamber to fast, may lead to outgassing inside the fluid. The driving speed may be modulated according to the specific fluid used, in order to enable the fastest possible suction cycle for the specific fluid. For example may the suction cycle start with a low driving speed, allowing for a low pressure drop due to a low flow rate, and increasing to a maximum fluid specific driving speed.

In a preferred embodiment of the method the driving speed is changed in order to lengthen or shorten the suction and/or dosing cycle. The driving speed of the driving means is the speed which basically determines the length of a suction and/or dosing cycle, wherein a slow driving speed leads to an increase cycle time and vice versa. This is especially advantageous for pumping a fluid through a long dosing line with a reduced velocity and/or pumping a high-viscosity fluid with a reduced velocity, due to the reduced friction based on the reduced velocity of the fluid and due to the reduced acceleration of the mass of the fluid. The driving speed may be further modulated.

DESCRIPTION OF THE FIGURES

Additional details, features, characteristics and advantages of the object of the invention are disclosed in the figures and the following description of the respective figures, which—in exemplary fashion—show one embodiment and an example of a dispensing system according to the invention. In the drawings:

The illustration in FIG. 1 shows an embodiment of the present invention. In FIG. 1 a diaphragm pump 10 is shown, comprising a pump housing 12. Inside the pump housing 12 two first check valves 14 and two second check valves 16 are located, wherein the first check valves 14 enable a fluid (not shown) to enter into a fluid chamber 18. During a dosing cycle the fluid is expelled from the fluid chamber 18 and moves through the opened second check valves 16, while the first check valves 14 are locked. One wall of the fluid chamber 18 is defined by a diaphragm 20, wherein the diaphragm 20 comprises a connector 22 which is connected to a con rod 24. The con rod 24 is attached to an eccentric 26, wherein the eccentric 26 is attached to a driving shaft 30 of a driving means 28 for reciprocating the diaphragm 20. The con rod 24 is attached to the eccentric 26 by a ball bearing 42 for reducing the friction when the diaphragm pump 10 is operating. The eccentric 26 comprises a face side 40, which faces away from the driving shaft 40 and towards a control unit 36 for controlling the operating of the diaphragm pump 10. An indicating means 32 is arranged on the face side 40 of the eccentric 26, facing a sensor 34 mounted on the control unit 36, in order to determine the angular position of the driving means 28. The driving means 28 in form of a stepper motor as well as the control unit 36 are arranged inside a casing 38, wherein the casing 38. The indicating means 32 on the face side 40 of the eccentric 26 may be configured to correspond to a dosing cycle or a suction cycle of the diaphragm pump 10, for example by being designed in a semi circle. This enables the sensor 34 on power up of the diaphragm pump 10 to detect whether the diaphragm 20 is positioned in a dosing cycle or a suction cycle. The control unit 36 may then rotate the driving shaft 30 and thus the diaphragm 20 until the sensor detects the end or the beginning of the indicating means, stopping the driving means 28. Thus, the control unit 36 may move the diaphragm 20 in a defined position, for example the beginning of the dosing cycle. The diaphragm pump 10 may be scaled in order to be able to dose about 6 liters/hour of a fluid, preferably about 15 liters/hour, more preferred about 50 liters/hour, most preferred about 80 liters/hour. The driving means may accordingly provide a torque of about 0.1 Nm, preferably about 5 Nm, most preferred about 6 Nm. The pressure for dosing the fluid may accordingly be about 0.2 bar, preferably about 2 bar, most preferred about 10 bar.

Figure 1:
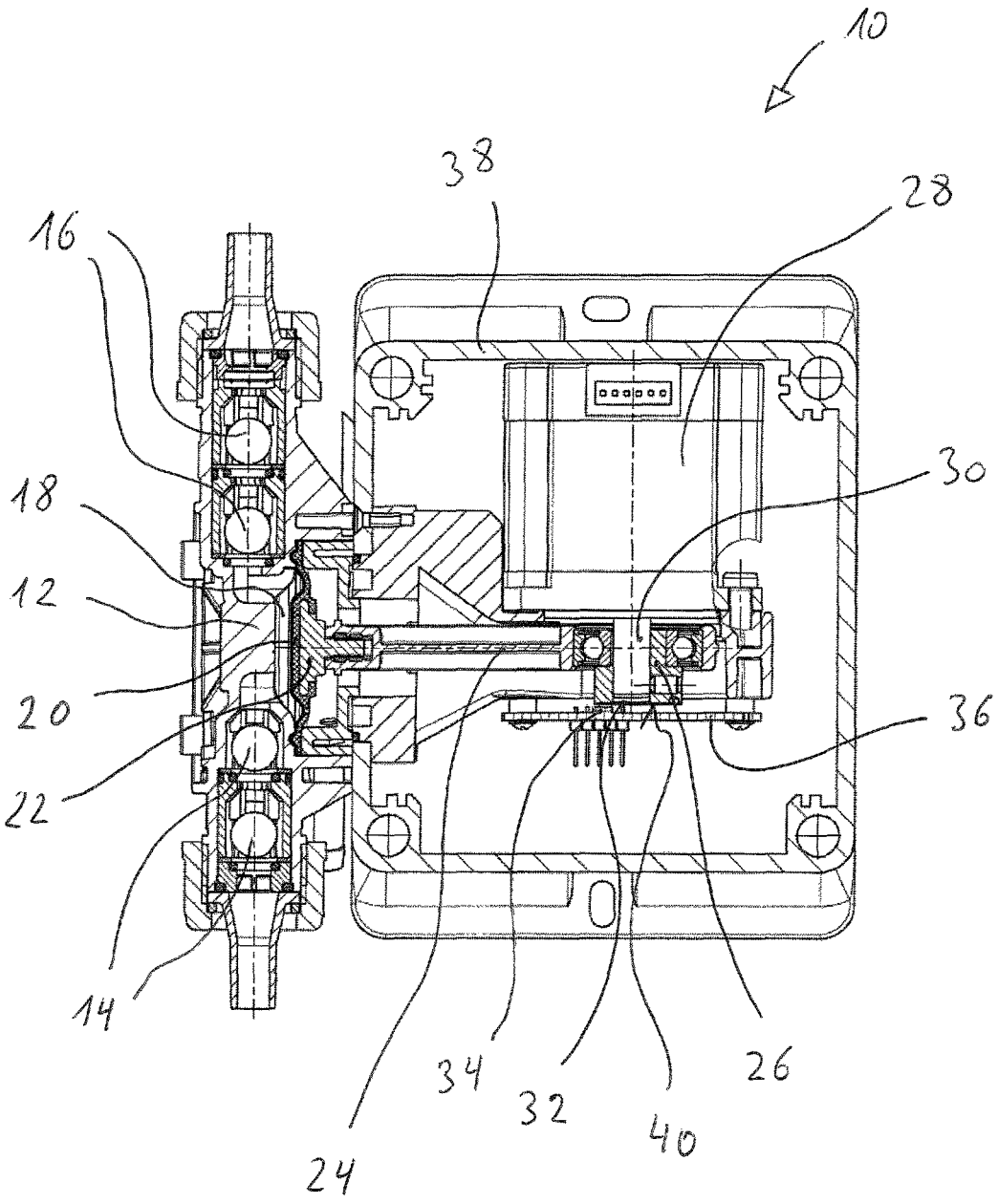
FIG. 1 shows a sectional drawing of a diaphragm pump according to the present invention.
Figure 2:
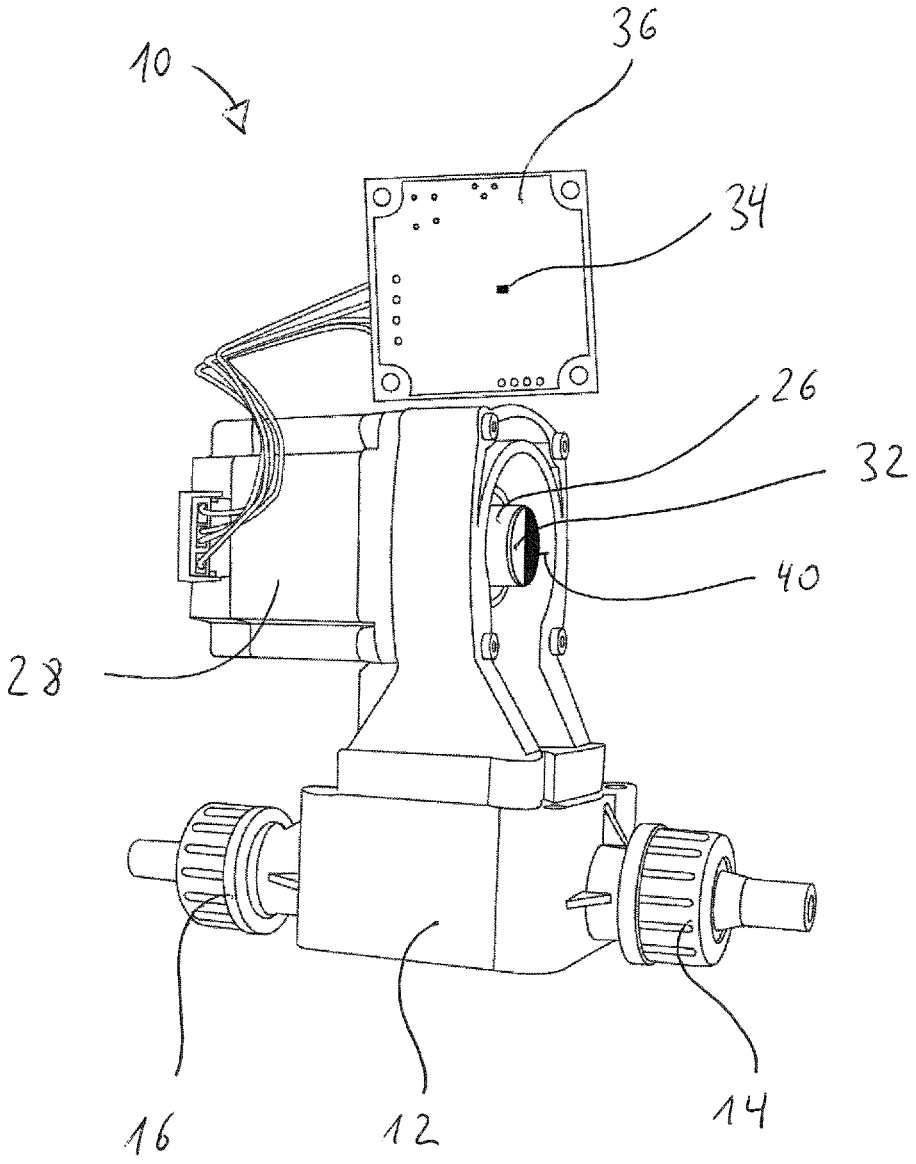
FIG. 2 shows a perspective view of a further embodiment of the diaphragm pump according to the present invention.

A further embodiment of the invention is shown in FIG. 2. The diaphragm pump 10 comprises a first check valve 14 and a second check valve 16 inside a pump housing 12, wherein the first check valve 14 opens on a suction cycle in order to permit a fluid to enter the fluid chamber (not shown) whilst the second check valve 16 is closed. During a dosing cycle the first check valve 14 is closed and the second check valve 16 opened in order for the fluid to leave the fluid chamber. The diaphragm (not shown) is driven by a driving means 28 in form of a stepper motor. Attached to the driving shaft (not shown) is an eccentric 26, which extends axially further than the driving shaft. The eccentric 26 comprises on a face side 40 the indicating means 32, wherein the indicating means 32 is designed in a semi circle shaped area, covering about half of the total face side 40 of the eccentric 26. The indicating means 32 is for example a reflective paint, wherein the indicating means 32 corresponds to a cycle, the suction cycle or the dosing cycle, of the diaphragm pump 10. Thus a sensor 34 integrated into the control unit 36 (shown detached) may determine if the diaphragm is in the position of a dosing cycle or a suction cycle, or at the beginning or end of a cycle. The control unit 36 is shown in a disassembled position.

The particular combinations of elements and features in the above detailed embodiments are exemplary only; the interchanging and substitution of these teachings with other teachings in this and the patents/applications incorporate by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by the way of example only and is not intending as limiting. In the claims, the wording "comprising" does not exclude other elements or steps, and the identified article "a" or "an" does not exclude a plurality. The mere fact that certain measures are recited in mutually different dependent claims does not indicate that a combination of these measures cannot be used to advantage. The inventions scope is defined in the following claims and the equivalents thereto. Furthermore, reference signs used in the description and claims do not limit the scope of the invention as claimed.

LIST OF REFERENCE SIGNS

10 diaphragm pump
12 pump housing
14 first check valve
16 second check valve
18 fluid chamber
20 diaphragm
22 connector
24 con rod
26 eccentric
28 driving means
30 driving shaft
32 indicating means
34 sensor
36 control unit
38 casing
40 face side
42 ball bearing

The invention claimed is:

1. A method for dosing a fluid, comprising the steps of:

(a) providing a diaphragm pump comprising:

(i) a pump housing with at least a first check valve and a second check valve;

(ii) a fluid chamber;

(iii) a diaphragm defining a wall of the fluid chamber which is reciprocatingly movable, (iv) a driving means with a driving shaft for reciprocating said diaphragm, the driving means is connected to the diaphragm by an eccentric and a con rod, the driving means being bidirectional, defining a first direction and a second direction opposite the first direction, the driving means driving in the first direction when driving the diaphragm through a dosing cycle and a suction cycle, a start of the dosing cycle and a start of the suction cycle each corresponding to a respective defined position of the diaphragm (v) a sensor, and (vi) a control unit;

(b) constantly detecting an absolute angular position of the driving means so as to determine a current position of the diaphragm and a nearest one of the respective defined positions, and (c) directly reciprocating the diaphragm based on the detected absolute angular position from the current position to the respective defined position along a shortest way, whereby the driving means drives the diaphragm in the first direction if the shortest way to the nearest one of the respective defined positions is via the first direction, and the driving means drives the diaphragm in the second direction if the shortest way to the nearest one of the respective defined positions is via the second direction.

2. The method according to claim 1, further comprising the steps of moving the diaphragm to the respective defined position at the beginning of the dosing cycle, or after completing a suction cycle for filling the fluid chamber.

3. The method according to claim 1, further comprising the step of modulating the driving speed in order to provide a constant volumetric flow of the fluid.

4. The method according to claim 1, further comprising the step of controlling the length of the dosing cycle in order to dose at least a part of the fluid with a basically constant volumetric flow for a given time.

5. The method according to claim 1, comprising the step of modulating the driving speed during the suction cycle in a way to avoid outgassing in the fluid.

6. The method according to claim 1, comprising the step of changing a driving speed in order to lengthen or shorten the suction and/or dosing cycle.

7. A diaphragm pump for use as a detergent dosage pump, comprising:

(a) a pump housing with at least a first check valve and a second check valve;

(b) a fluid chamber;

(c) a diaphragm defining a wall of the fluid chamber which is reciprocatingly movable;

(d) a motor with a driving shaft for reciprocating said diaphragm, the motor being connected to the diaphragm by an eccentric and a con rod, the motor being configured to directly reciprocate the diaphragm, the motor being configured to drive the diaphragm through a dosing cycle or a suction cycle, a start of the dosing cycle and a start of the suction cycle each corresponding to a respective defined positions of the diaphragm, the motor being bidirectional, defining a first direction and a second direction opposite the first direction, the motor driving in the first direction when driving the diaphragm through a dosing cycle and a suction cycle; and (e) a sensor arranged to constantly detect an absolute angular position of the motor so as to determine a current position of the diaphragm and a nearest one of the respective defined positions, wherein upon power up of the diaphragm pump, the motor directly drives the diaphragm based on the detected absolute angular position from the current position to one of the respective defined positions along a shortest way, the motor driving the diaphragm in the first direction if the shortest way to the nearest one of the respective defined positions is via the first direction, the motor driving the diaphragm in the second direction if the shortest way to the nearest one of the respective defined positions is via the second direction.

8. The diaphragm pump according to claim 7, wherein the motor is a hybrid stepping motor.

9. The diaphragm pump according to claim 7, wherein the eccentric is directly attached to the driving shaft of the motor.

10. The diaphragm pump according to claim 7, further comprising an indicating means connectable to the motor and/or the eccentric, and the sensor being configured to detect the indicating means.

11. The diaphragm pump according to claim 10, wherein the indicating means is a reflective surface arranged on at least a part of the peripheral area and/or a face side of the motor and/or the eccentric.

12. The diaphragm pump of claim 10, wherein the motor drives the diaphragm immediately after power up of the diaphragm pump through the dosing cycle until the sensor no longer detects the indicating means.

13. The diaphragm pump of claim 10, wherein the motor drives the diaphragm immediately after power up of the diaphragm pump through the suction cycle until the sensor begins detecting the indicating means.

14. The diaphragm pump of claim 10, wherein the indicating means extends about 180 degrees along a peripheral surface of the driving shaft and/or the eccentric.

15. The diaphragm pump according to claim 10, wherein the sensor is integrated into a control unit.

16. The diaphragm pump of claim 10, wherein the direction in which the diaphragm is driven by the motor is based on the indicating means being detectable by the sensor.

17. The diaphragm pump according to claim 7, wherein the con rod is directly attached to the diaphragm by a bolted connection.

* * * * *